United States Patent [19]

Banke

[11] Patent Number: 4,872,407

[45] Date of Patent: Oct. 10, 1989

[54] METHOD FOR THE MOUNTING OF A FLEXIBLE PRINTING PLATE ON A CYLINDER, AND APPARATUS FOR THE EXECUTION OF THE METHOD

[76] Inventor: Allan Banke, c/o Neoplex A/S, Lyøvej 6, DK-5800 Nyborg, Denmark

[21] Appl. No.: 263,794

[22] PCT Filed: Feb. 24, 1988

[86] PCT No.: PCT/DK88/00034

§ 371 Date: Oct. 24, 1988

§ 102(e) Date: Oct. 24, 1988

[87] PCT Pub. No.: WO88/06522

PCT Pub. Date: Sep. 7, 1988

[30] Foreign Application Priority Data

Feb. 27, 1987 [DK] Denmark ..... 1057/87

[51] Int. Cl.[4] ..... B41F 27/00

[52] U.S. Cl. ..... 101/389.1; 101/DIG. 36; 101/401.1; 33/617

[58] Field of Search ..... 101/401.1, 401.3, 383, 101/DIG. 36, 485, 389.1; 33/184.5

[56] References Cited

U.S. PATENT DOCUMENTS

| | | | |
|---|---|---|---|
| 3,390,633 | 7/1968 | Boughton | 101/401.1 |
| 3,983,808 | 10/1976 | Jackson | 101/401.3 |
| 4,033,299 | 7/1977 | Schuhmann | 101/DIG. 36 |
| 4,055,120 | 10/1977 | Kamm | 101/DIG. 36 |
| 4,380,956 | 4/1983 | Elworthy | 101/401.1 |
| 4,383,760 | 5/1983 | Deter et al. | 33/184.5 |
| 4,449,452 | 5/1984 | Mansell | 101/DIG. 36 |
| 4,582,768 | 4/1986 | Takeuchi et al. | 101/DIG. 36 |
| 4,589,338 | 5/1986 | Collins et al. | 101/DIG. 36 |
| 4,611,539 | 9/1986 | Ireton | 101/DIG. 36 |

*Primary Examiner*—Eugene H. Eickholt

*Attorney, Agent, or Firm*—Antonelli, Terry & Wands

[57] ABSTRACT

An apparatus for the mounting of a flexible printing plate (2) on a plate cylinder (1) comprises optical spotting devices (6) arranged to read register marks (5, 5') on the printing plate outside the printing plate picture (3).

The printing plate (2) is secured and positioned in correct alignment in plane state on a not-shown two-part table before the mounting, after which the table is fed (20) towards the cylinder (1) until the printing plate adheres to the cylinder along a head line vertically above the cylinder axis, after which the two parts of the table are removed to each their sides of the cylinder and the printing plate is folded around the cylinder.

5 Claims, 2 Drawing Sheets

Fig. 1
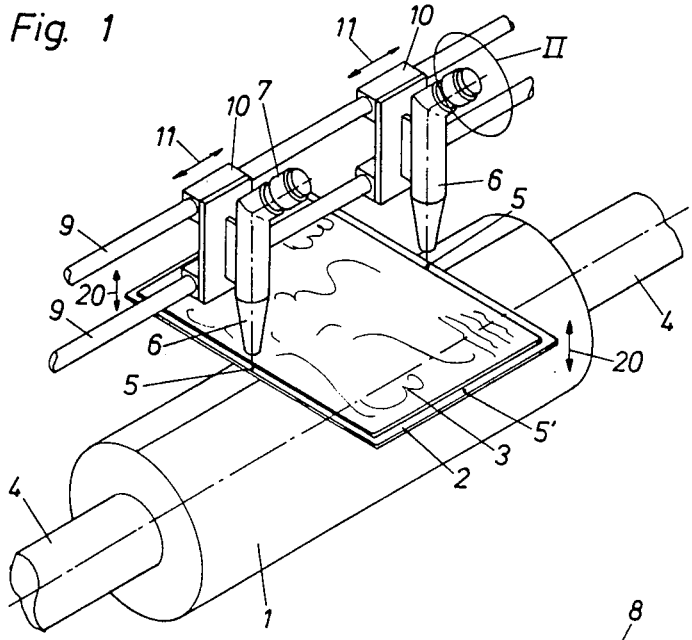
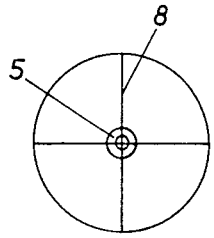
Fig. 2
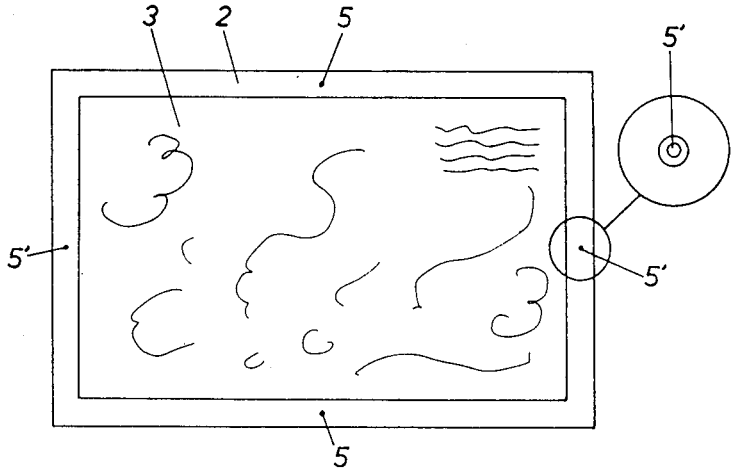
Fig. 3

METHOD FOR THE MOUNTING OF A FLEXIBLE PRINTING PLATE ON A CYLINDER, AND APPARATUS FOR THE EXECUTION OF THE METHOD

BACKGROUND AND SUMMARY OF INVENTION

The invention relates to a method for the mounting of a flexible printing plate on a plate cylinder for a printing machine, and an apparatus for the execution of the method. More particularly, the invention relates to a method for the mounting of a flexible printing plate on a plate cylinder for a printing machine where the surface of the printing plate is provided with adhesive coating, and where the printing plate is provided with at least one pair of register marks, in that the printing plate is aligned in accordance with the register marks by means of optical spotting devices disposed in a certain position in relation to the plate cylinder, and is secured in position of correct alignment by a holding device at a distance from the plate cylinder. The apparatus for the execution of the method comprises holding devices for at least one plate cylinder arranged to carry a printing plate with at least one pair of register marks, in that the surface of the cylinder or the back of the printing plate is provided with an adhesive coating.

Several different methods and aids are known to be used in the mounting of a flexible printing plate on a plate cylinder for so-called flexographic printing with stereotype printing plates of plastic or rubber. This form of printing is often used with raster prints with several colours, or as normal relief printing with a number of colour prints after each other.

One of the aids used is a so-called pin device, which is a mechanical aid, and which is used in the mounting of printing plates for flexo-printing when the printing task does not demand great precision.

For finer printing tasks with great precision and four-six colours, a so-called reflection mounting device is used, cf. for example European patent document no. 0,015,471.

A newer method consists of providing the printing plate with a number of holes, these being drilled or punched along one of the edges of the printing plate, said holes corresponding to pins on a transverse rail, so that the printing plate is secured at the moment of mounting, cf. for example Norwegian patent document no. 126,725, and U.S. Pat. No. 4,380,956. Where the actual mounting is concerned, this method is excellent, but it demands an extra process with very precise location of the holes in the printing plate, whereby the cost of the printing plate is considerably increased.

From the description of U.S. Pat. No. 2,711,691, there is known a printing plate mounting table which is arranged to be displaced tangentially in relation to a printing cylinder and in firm engagement therewith, in that the undersides of the table's side members are formed as toothed racks which enter into engagement with gearwheels mounted on the axle journals of the printing cylinder. The table has a head line which indicates the printing plate table's foremost limit for the extent of the print picture, said line corresponding with the start point (the line) on the printing cylinder. Above the printing cylinder there are parallel guideways for optical spotting devices, and the printing plate is provided with register marks arranged for checking the position of the printing plate on the cylinder when it has been mounted in accordance with the head line on the table. If the register check shows that the mounting of the printing plate is incorrect, one must start from the beginning again.

The known methods and devices are encumbered with a number of sources of error, and with some of the methods the result of the mounting depends on the operator's skill and knowledge of both the mounting device and the subsequent printing process, particularly if a good product is to be obtained from the printing machine in the production of multi-colour prints. The known methods are moreover very time consuming and contribute to a heavy increase in the cost of multi-colour prints.

The object of the invention is to present a method and an apparatus for the mounting of a flexible printing plate on a plate cylinder (printing cylinder), whereby the drawbacks of the known technique are avoided, the time consumed in the mounting is strongly reduced, the mounting precision is considerably increased, and the demand for specialist knowledge among operators can be reduced, in that the actual mounting is not effected until the correct registration has been ensured.

This is achieved by proceeding according to the method of invention and with an apparatus of the invention. The method of the invention is characterized in that the distance between the printing plate and the plate cylinder is reduced by parallel movement of the secured printed plate or the plate cylinder, until the printing plate touches the cylinder tangentially and adheres thereto along a cylinder head line, after which the printing plate is released from the holding device and its application to the print cylinder is completed. The apparatus of the invention is characterized in that parallel with the axis of the plate cylinder, holding devices are provided with means for securing the printing plate parallel with but without touching the cylinder. A number of optical spotting devices are provided at the holding device. Means for feeding the printing plate towards the cylinder or vice versa are also provided.

The reduction in the time consumption and the increase in precision are achieved because the printing plate is secured by a holding device when it has been positioned completely correctly by means of the register marks, and the printing plate is secured in its correct position by the holding device while, with a movement in relation to the cylinder, it is applied to said cylinder. The cylinder is provided beforehand with an adhesive layer, for example in the form of a double adhesive tape. Since the mounting is effected by a movement, during which the printing plate is constantly held parallel with the cylinder, one can re-check the registration by means of the optical spotting devices during the whole of the mounting procedure. Practical experiments have shown that the time used in mounting can be reduced to around a fifth of the time consumed when using the reflection mounting device, and that mounting precision is increased many times, whereby the printing result is greatly improved through the better registration.

Furthermore, the expensive punching or drilling of holes in the printing plate is avoided, and also the possible risk this entails of inaccurate positioning of the holes which makes it impossible to use the holes as means of registration.

A precondition for the method and the mode of operation of the apparatus, and thus the subsequent very precise and quick mounting, is that prior to the mounting the printing plate is provided with register marks. These are preferably located outside the actual printing plate picture, and are produced at the same time as the printing plate picture. The register marks are preferably produced with some photographic chemical process as the printing plate picture, and are very small in relation thereto and of the size 0.05–0.5 mm in diameter. It is obvious that the register marks will leave an impression on the material outside the picture, but in many cases this can be accepted, for example when printing multicolour packaging, because the impression of the register mark is so small that it appears merely as a dot on the material. Of course, there is nothing to prevent these register marks being cut off or milled off immediately before the actual printing commences, but this means that the printing plate can not be mounted again following the method and using the apparatus according to the invention. The register marks are preferably located outside the print picture because this affords increased precision, and register marks in the print picture itself are avoided.

Preferably, a pair of register marks are used which are disposed, close to two opposite edges on the printing plate, and such that they lie above that line on the back of the printing plate which first touches the cylinder during the mounting so that the printing plate is mounted with the register marks lying precisely vertical over the cylinder axis.

The optical spotting devices are preferably placed on a parallel guideway so that they can be displaced parallel with the cylinder axis and secured in a desired position, and in that they focus towards the axis of the cylinder, thus enabling them to be placed and secured in the correct position in relation to the register marks as quickly as possible. Moreover, the registration can be checked when the printing plate is led down towards the cylinder, so that the actual registration can be rechecked immediately prior to the mounting itself. If a further set of registration marks are provided at the two other opposite sides of the printing plate, these marks can be used for re-checking of the mounted printing plate.

The apparatus according to the invention is preferably further characterized in that the holding devices are a two-part table, the two parts of which are provided with vacuum channels with openings towards the table surface, which is a plane. The printing plate can hereby be secured and positioned very simply by means of a two-part table until the correct registration has been achieved. It is obvious that other means, such as weights or mechanical clamping elements, can be used to secure the printing plate on the two-part table, but by configuring the table as a so-called suction table, possibly with regulation of the vacuum, provides an apparatus which can be operated very quickly. Instead of a two-part suction table, tongs or clamping arrangements can be used which hold the printing plate stretched out immediately above the cylinder, said tongs or clamping arrangements being capable of traversing upwards or downwards, for example by means of parallel ball-type guideways, or one can lead the cylinder towards the printing plate.

The table is preferably placed on a member of parallel guides so that they can be displaced independently in a direction at right-angles to the cylinder. This provides the possibility of removing the two-part table without any movement on the part of the printing table, the reason being that the printing plate is in contact with the cylinder and adhered firmly to this along a line over the centre. The two table plates are led parallel out to each side, and the rest of the printing plate is folded around the cylinder in the normal manner.

Finally, the apparatus according to the invention can be configured such that the parallel guides are secured in perpendicular, parallel-guide mechanisms, so that the parts of the two-part table can be fed simultaneously towards the cylinder, without the register makes leaving the sighting line between the spotting devices and the axis of the cylinder. The printing plate can thus be displaced in a direction at right angles to the cylinder, without the registration marks leaving the sighting line.

The spotting devices are preferably sighting microscopes with a magnification of 5–30 times, and in which cross-hairs are provided, preferably in the microscope's ocular or objective whereby the precision of the positioning of the printing plate in accordance with the register marks is greatly increased.

BRIEF DESCRIPTION OF DRAWINGS

The invention will now be described in more detail with reference to the drawings wherein FIG. 1 is a sketch showing the principle of the invention.

FIG. 2 shows the actual sighting image on a larger scale,

FIG. 3 shows a printing plate provided with register marks, and

DETAILED DESCRIPTION OF DISCLOSED EMBODIMENT

Figure 4:
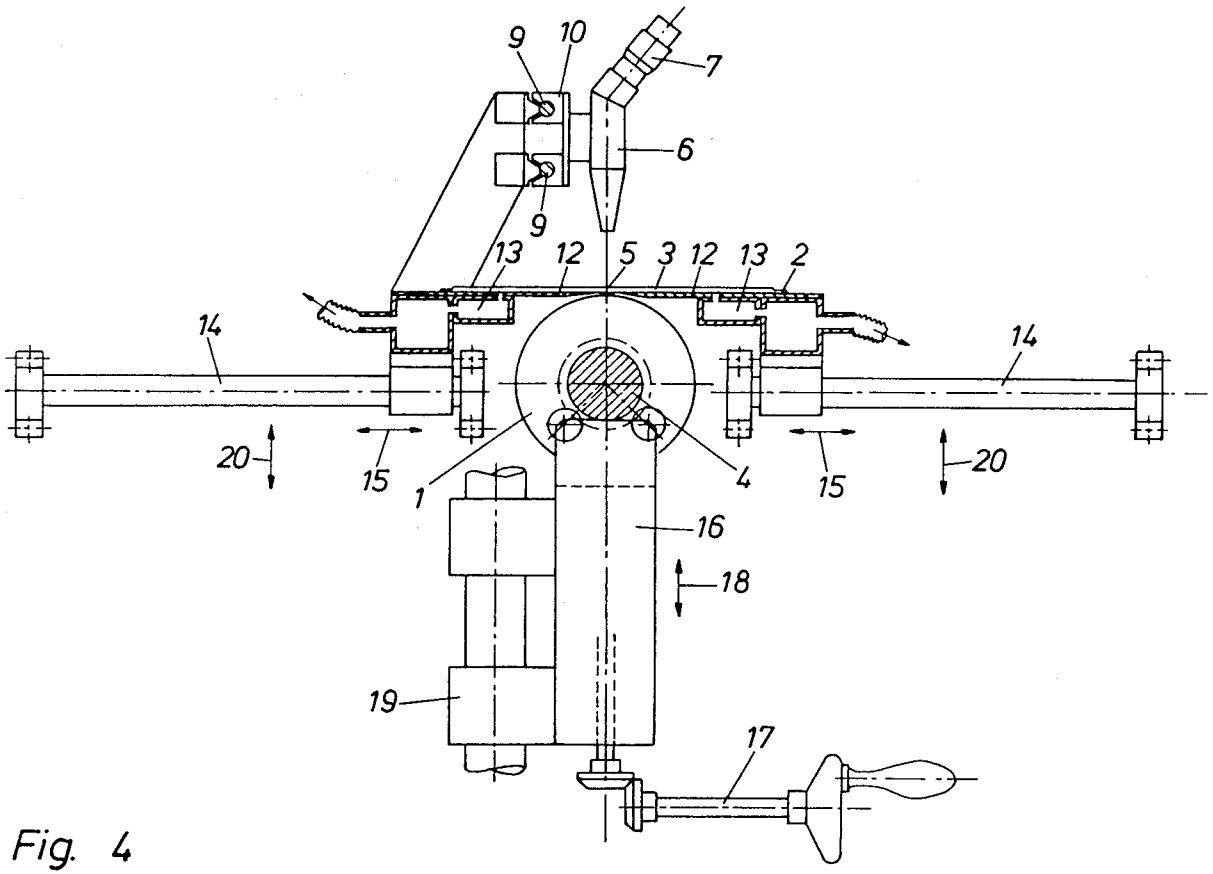
FIG. 4 shows in detail an embodiment of the apparatus according to the invention.

On a normal flexible printing plate 2, outside the print picture 3, pairs of register marks 5 and/or 5' are provided, these being approximately 0.05–0.5 mm, preferably 0.2–0.3 mm in diameter. The register marks are produced photographically-chemically on the printing plate in the same way as the actual print picture 3, for example in the form of a relief printing picture.

When such a printing plate is to be mounted on a plate cylinder 1, the cylinder is first cleaned in the normal way and provided with an adhesive layer, for example in the form of a double adhesive tape. The cylinder 1 is placed in a holder 16, where the cylinder's axle journals 4, which moreover carry notshown drive gears, rest on smaller rollers, so that the cylinder can be rotated during the cleaning and the applying of the tape. In addition, means are provided for securing the cylinder so that it lies immovably fixed during the mounting of the printing plate, plus possible index-elements if two or more printing plates are to be mounted per circumference.

The holder 16 is adjustable for height in the direction shown by the arrow 18, for example by means of the maneuvering element 17 and the ball guide 19, see FIG. 4. FIG. 4 of the drawing shows an embodiment of the apparatus according to the invention, seen from the cylinder end and shown partly in section. The printing plate 2 is placed on a two-part table 12, which is a plane-ground, steel table with underlying vacuum channels 13, which with a number of small holes in the table 12 form a suction table. The table 12 is placed at a distance from the cylinder 1, so that the printing plate 2 is not in contact with the double adhesive tape thereon.

By means of the optical spotting devices 6 with oculars 7 having cross-hairs 8, the printing plate 2 is positioned correctly on the table 12, in that the printing plate can be shifted on the table, but still secured by the suction from the vacuum chambers 13. The optical spotting devices 6 are individually secured in respective ball guides 10, and can be displaced parallel with the cylinder axis on the bars 9 in the direction of the arrow 11 and locked in any desired position. The optical spotting devices focus vertically downwards towards the centre line of the printing cylinder. The sighting image is shown in FIG. 2, and shows here the correct positioning of the printing plate, in that the plate is positioned so that the register mark 5 sits precisely in the cross-hairs 8.

The printing plate 2 is now positioned correctly in relation to the cylinder 1, and particularly in relation to the centre axis of the cylinder, and the printing plate shall hereafter be mounted on the cylinder. This is effected by a parallel displacement of the two-part table 12 in the direction shown by the arrows 20, or by the cylinder 1 being moved upwards towards the printing plate until the printing plate just touches the cylinder 1 in the free area between the two parts of the two-part table. The means of displacement for this purpose are not shown in the drawing, but use can be made of any form of generally-known ball-guides or the like disposed in a parallel manner. However, these parallel guides are not necessary if the apparatus is arranged to lead the cylinder towards the printing plate. When the printing plate just touches the cylinder 1 along a line vertically over the cylinder axis, it will stick firmly to the cylinder along a line precisely vertically over the cylinder axis. The printing plate is now completely ready for mounting, and for safety's sake one can use the optical spotting devices 6 to check whether the register marks still show the correct position of the printing plate. If this is the case, the two halves of the two-part table 12 are moved to their respective sides by means of the parallel guides 14, so that the rest of the printing plate can be folded around the cylinder. Before the cylinder is removed from the apparatus and transferred to the printing machine, one can check by means of the optical spotting devices and the register marks 5 or 5' that the printing plate is still in correct registration.

It will be obvious to those familiar with the art that the invention can be executed by lifting the cylinder 1 instead of lowering the table 12, and that instead of adhesive on the cylinder, one can use adhesive on the back of the printing plate, merely provided that the table 12 is surface treated so that the printing plate does not stick to it, or by covering the underside of the printing plate, for example with silicone paper, of which a central strip is removed at the commencement of the mounting, and the rest removed after the printing plate has been brought into adhesive contact with the cylinder along a generatrix line. In addition to the mentioned methods of securing with suction table, tongs and clamping arrangements, any other form of interim securing of the printing plate can be used.

To those familiar with the art, it is also obvious that the holding elements for holding the printing plate can be arranged lowermost and the cylinder uppermost, for example so that the cylinder is lowered towards the printing plate for contact and mounting, or the table is raised towards the cylinder. It will thus be sufficient to have a stationary tabletop, or a tabletop which can be raised, with a narrow slot through which the printing plate's register marks, which now face downwards, can be observed through underlying optical spotting devices. The optical spotting devices are, for example, each equipped with a television camera, and the sighting images are shown on a screen at a convenient height. When the printing plate is mounted from below, the cylinder is raised and conveyed to the printing machine. One thus avoids having to configure the table in two parts, so that the parts can be moved to the side when the cylinder is to be removed from the apparatus. In reality, this form of embodiment corresponds to the drawing being turned 180°.

I claim:

1. Apparatus for mounting a flexible printing plate on a plate cylinder for a printing machine comprising holding devices for at least one plate cylinder arranged to carry a printing plate with at least one pair of register marks, where the surface of the cylinder or the back of the printing plate is provided with an adhesive coating, wherein parallel with the axis of the cylinder, holding devices are provided with means for securing the printing plate parallel with and without touching the cylinder, and further comprising a number of optical spotting devices at the holding devices, and means for feeding the printing plate towards the cylinder or vice versa, and wherein the holding devices are a two-part table, the two parts of which are provided with vacuum channels with openings towards the table surface, which is plane.

2. Apparatus according to claim 1, further comprising a parallel guideway and wherein the optical spotting devices are placed on the parallel guideway so that they can be displaced parallel with the cylinder axis and secured in a desired position, and in that they focus towards the axis of the cylinder.

3. Apparatus according to claim 1, wherein the table is placed on a number of parallel guides, so that they can be displaced independently in a direction at right-angles to the cylinder.

4. Apparatus according to claim 3, wherein the parallel guides are secured in perpendicular, parallel-guide mechanisms, so that the parts of the two-part table can be fed simultaneously towards the cylinder, without the register marks leaving a sighting line between the spotting devices and axis of the cylinder.

5. Apparatus according to claim 1, wherein the spotting devices are sighting microscopes with a magnification of 5–30 times, and in which cross-hairs are provided in the microscope's ocular or objective.

* * * * *